US008419603B2

(12) United States Patent
Terlau

(10) Patent No.: US 8,419,603 B2
(45) Date of Patent: Apr. 16, 2013

(54) METHOD FOR FOLDING SHEETS

(75) Inventor: Martin Terlau, Murrhardt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 531 days.

(21) Appl. No.: 12/564,137

(22) Filed: Sep. 22, 2009

(65) Prior Publication Data

US 2010/0075822 A1 Mar. 25, 2010

(30) Foreign Application Priority Data

Sep. 22, 2008 (DE) ..... 10 2008 048 286

(51) Int. Cl.
*B31F 7/00* (2006.01)

(52) U.S. Cl.
USPC ..... 493/421; 493/420; 493/419

(58) Field of Classification Search ..... 493/421, 493/420, 443, 444, 445, 419, 417, 416, 413
See application file for complete search history.

(56) References Cited

U.S. PATENT DOCUMENTS

| | | | | | |
|---|---|---|---|---|---|
| 3,975,009 | A | * | 8/1976 | Brown | 493/14 |
| 4,163,548 | A | | 8/1979 | Nystrand | |
| 4,419,088 | A | * | 12/1983 | Nemec | 493/444 |
| 4,534,550 | A | * | 8/1985 | Reist | 271/183 |
| 4,621,966 | A | * | 11/1986 | Luperti et al. | 414/789.9 |
| 4,850,945 | A | * | 7/1989 | Whittenberger | 493/14 |
| 4,898,570 | A | * | 2/1990 | Luperti et al. | 493/420 |
| 5,022,644 | A | * | 6/1991 | Burge | 271/270 |
| 5,037,364 | A | * | 8/1991 | Whittenberger | 493/14 |
| 5,042,792 | A | * | 8/1991 | Honegger et al. | 271/188 |
| 5,162,036 | A | * | 11/1992 | Peter et al. | 493/416 |
| 5,165,674 | A | * | 11/1992 | Petersen | 270/47 |
| 5,246,415 | A | | 9/1993 | Fuss | |
| 5,288,067 | A | * | 2/1994 | Stock | 271/276 |
| 5,871,433 | A | * | 2/1999 | Lehmann et al. | 493/420 |
| 6,843,359 | B2 | * | 1/2005 | Ballestrazzi et al. | 198/418.6 |
| 6,935,998 | B2 | * | 8/2005 | Silvestre | 493/405 |
| 2010/0075821 | A1 | * | 3/2010 | Terlau | 493/419 |

FOREIGN PATENT DOCUMENTS

| | | | |
|---|---|---|---|
| DE | 2902268 | A1 | 7/1979 |
| DE | 29 40 360 | A1 | 4/1981 |
| DE | 3830754 | A1 | 3/1989 |
| DE | 41 14 105 | A1 | 11/1992 |
| DE | 10 2004 041 471 | A1 | 4/2005 |
| DE | 103 36 757 | A1 | 2/2006 |
| DE | 10 2006 055 301 | A1 | 5/2008 |
| EP | 1 297 969 | A2 | 4/2003 |
| GB | 437809 | A | 11/1935 |

* cited by examiner

*Primary Examiner* — Sameh H. Tawfik
(74) *Attorney, Agent, or Firm* — Laurence A. Greenberg; Werner H. Stemer; Ralph E. Locher

(57) ABSTRACT

A folding machine and a folding method perform overlapped folding of sheets of paper, paperboard and the like. The folding machine has at least one first and one second folding station each having driven folding rolls, a transport device disposed between the first and second folding stations, a drive and a common control unit connected to the drives. The products are transported between the first and the second folding stations in an overlapping manner.

4 Claims, 5 Drawing Sheets

METHOD FOR FOLDING SHEETS

CROSS-REFERENCE TO RELATED APPLICATION

This application claims the priority, under 35 U.S.C. §119, of German Patent Application DE 10 2008 048 286.2, filed Sep. 22, 2008; the prior application is herewith incorporated by reference in its entirety.

BACKGROUND OF THE INVENTION

1. Field of the Invention

The invention relates to a method for folding sheet-shaped elements in a folding station of a folding machine, in which the folding station has at least one folding unit and the sheet elements are supplied to the folding station in a transport direction with their leading edge in front and with an overlap. The invention also relates to a folding machine for folding sheet-shaped elements of paper, paperboard and the like, in particular for implementing the method according to the invention, having at least one first and one second folding station, each having driven folding rolls, a transport device disposed between the first and second folding stations, a drive and a common control unit connected to the drives.

2. Description of the Related Art

Firstly, pocket folding machines are known from the prior art. The structure of a pocket folding machine having a large number of pocket folding units is disclosed in German Published, Non-Prosecuted Patent Application DE 10 2004 041 471 A1. A respective pocket folding unit thereof includes a folding pocket and three folding rolls, which are disposed in two pairs of folding rolls. Furthermore, blade folding machines are known. German Published, Non-Prosecuted Patent Application DE 29 40 360 A1 discloses a single-blade folding unit for folding printed and pre-folded sheets. In combined folding machines, pocket folding units and blade folding units are combined. In that case, parallel folds are folded in pocket folding units in a first folding station, and cross folds are folded in blade folding units in a following folding station. German Published, Non-Prosecuted Patent Application DE 10 2006 055 301 A1 shows combined folding machines having a plurality of pocket folding units and blade folding units disposed downstream.

In order to increase the output of folding machines, which means their productivity, the speed of passage of the sheets through the folding machine is normally increased. However, as a result of the increase in the speed, a respective folded sheet experiences deformation and damage, which leads to considerable costs in terms of quality.

German Published, Non-Prosecuted Patent Application DE 103 36 757 A1 reveals methods for folding sheets supplied overlapping in the form of an imbricated stream. As a result of the application of the method, the productivity of the folding machines is intended to be increased without increasing the speed of passage of the sheets through the machine. To that end, folding gap widths of infeed folding rolls are enlarged or reduced as a function of a folding cycle in partial phases of a continuous folding operation. Such a procedure is disadvantageous since, in order to adapt the folding gap width, firstly a complicated mechanical mounting of the folding rolls and also complicated activation of the drives for adapting the folding gap width are necessary. It is further disadvantageous that sheets following one another meet in the folding units and are moved at a different speed relative to one another. In the process, the sheets can be damaged and it is possible for so-called markings to occur. As a result of the relative movement of the two sheets, increased folding tolerances, electrostatic charging and disruption in the area of the pocket infeed can be caused.

SUMMARY OF THE INVENTION

It is accordingly an object of the invention to provide a folding method and a folding machine, which overcome the hereinafore-mentioned disadvantages of the heretofore-known methods and machines of this general type and which require no structural modifications to existing folding units.

With the foregoing and other objects in view there is provided, in accordance with the invention, a method for folding sheet-shaped elements in a folding machine having a folding station with at least one folding unit. The method comprises supplying the sheet-shaped elements to the folding station in a transport direction with leading edges of the sheet-shaped elements in front and with an overlap, folding the sheet-shaped elements upward with a first folding length in the at least one folding unit, producing a fold, fold line or break transversely with respect to the transport direction to create a first folded product, defining a distance between the leading edge of a first folded sheet-shaped element and the leading edge of a following sheet-shaped element in each case to be greater than or equal to zero, and dimensioning the overlap to correspond at most to the first folding length.

Therefore, the invention relates to a method for the overlapping folding of sheet-shaped elements, in particular of printed sheets of paper, paperboard and the like, in a folding machine. For this purpose, the folding machine has at least one folding station with at least one folding unit. The sheet-shaped elements are supplied to the folding station in a transport direction with their leading edge in front and with an overlap. In this case, according to the invention the overlap corresponds at most to a first folding length. In the folding unit, a fold is produced in a respective sheet-shaped element transversely with respect to the transport direction, and the sheet elements are folded upward with a first folding length, which means that the leading edge of a respective sheet element is laid on its top side. In this case, the fold is such that the distance between the laid-over leading edge of a first sheet element and the leading edge of a following, not yet folded sheet element is greater than or equal to zero. This means that the leading edges are also spaced apart from one another after the first fold or, in the limiting case, rest on one another. Therefore, as viewed in the transport direction, the leading edge of a first sheet element lies downstream of the leading edge of a following, not yet folded sheet element. It is therefore ensured that a first incoming sheet element and a following, second incoming sheet element do not meet.

In accordance with another mode of the invention, the overlapped folds according to the invention can in this case be carried out in a pocket folding station or a parallel blade folding station. The parallel blade folding station in this case has a first, upper folding blade acting from above. Following the overlapped folding described above, the folded product produced in the process can be processed further through the use of further folds, be it in following folding units of the same folding station and/or in following folding stations.

When folding sheets in a non-overlapped way in accordance with the prior art, in each case a distance of about 5 to 8 cm must be present between the sheets supplied to a folding unit. This achieves the situation where the folding operation in the first folding unit has already been completed before a following sheet runs into the folding unit. As a result of applying the method according to the invention, it is possible to dispense with the spacing of the sheets as they run into the second folding station; the sheets are even run with an overlap. As a result of the overlapping of the sheets, more sheets can be folded at the same speed and with the same quality, and the output of the folding machine is increased. Adaptation of the folding units is not necessary in this case.

With the objects of the invention in view, there is also provided a folding machine for folding sheet-shaped elements of paper or paperboard, in particular for implementing the method according to the invention. The folding machine comprises at least one first and at least one second folding station each having driven folding rolls. Each of the folding stations has at least one drive. A transport device, which has a drive, is disposed between the at least one first and the at least one second folding station and is configured to transport products in an overlapping manner between the at least one first and the at least one second folding station. A control unit is connected in common to the drives.

Therefore, the invention also relates to a folding machine for folding sheets of paper, paperboard and the like having at least one first and one second folding station. A transport device is disposed between the first and second folding stations. The folding stations each have folding rolls which are driven by drives and the transport device likewise has a drive. The drives are in each case connected to a common control unit and activated by the latter. The transport speed of the first folding station in this case is higher than the transport speed of transport device and second folding station. As a result, the products are advantageously transported between the first and second folding stations with an overlap.

In accordance with another feature of the folding machine of the invention, a third folding station is disposed downstream of the second folding station. This third folding station can have pocket folding units or blade folding units.

In accordance with a further feature of the folding machine of the invention, an apparatus for applying adhesive to the products is placed in front of at least one folding station.

In accordance with an added feature of the folding machine of the invention, an apparatus for trimming the products is disposed downstream of at least one folding station. Through the use of the apparatus for applying adhesive and the apparatus for trimming the products, it is advantageously possible to produce small books, so-called booklets, from the sheets.

In accordance with an additional feature of the folding machine of the invention, an apparatus for pressing the products is disposed downstream of at least one folding station. Bulging of the products can advantageously be prevented by pressing the products.

The method according to the invention for the overlapped folding of sheets of paper, paperboard and the like in a folding machine can, for example, be implemented as follows:

In a first step, sheets are transported to a first folding station in a first transport direction. In this case, the shorter sides of a respective sheet are located parallel to the first transport direction. In a second step, the cross-folding of the sheets is carried out in the first folding station. In the process, first folded products are produced. In a third step, the first folded products are deflected in a second transport direction through the use of a transport device and then transported onward. The second transport direction is perpendicular to the first transport direction. In this case, the longer sides of a respective first folded product are oriented parallel to the second transport direction. The folded products are transported onward by the transport device and supplied to a second folding station having pocket folding units in such a way that the folded products overlap. This means that the upstream end of a first folded product is covered by a following, second folded product. In a fourth step, twice repeated folding is carried out in the second folding station. In this case, the folding involves off-center zigzag or zigzag wound or wound folds with folds, fold lines or breaks at equal intervals. This means that all of the folding pockets have the same infeed length. In order to produce the first fold in this folding station, the first folded product runs into an upper folding pocket. During this fourth step, two folded products are produced. The second folded product can then be transported onward through the use of a second transport device and supplied to a third folding station. There, the second folded product is folded centrally, transversely with respect to the longer side of the second folded product, with a third folded product being produced. In this case, the fold can be produced in a pocket folding unit or a blade folding unit.

Other features which are considered as characteristic for the invention are set forth in the appended claims.

Although the invention is illustrated and described herein as embodied in a folding method and a folding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
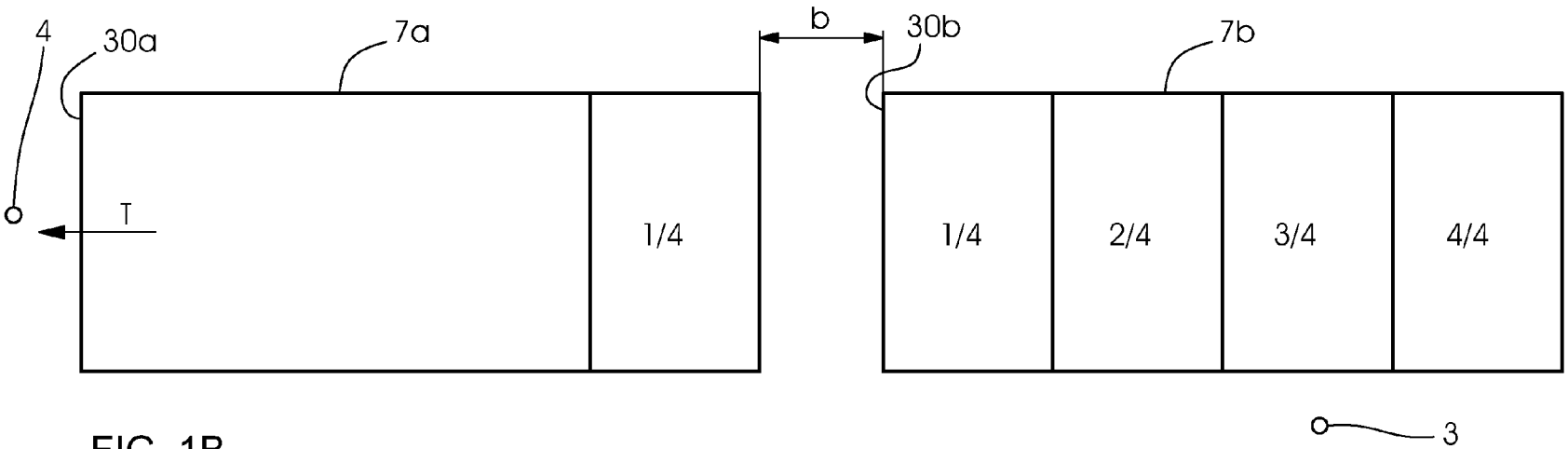
FIG. 1A is a diagrammatic, top-plan view showing two signatures spaced apart.

Referring now to the figures of the drawings in detail and first, particularly, to FIG. 1A thereof, there are seen two sheet elements, in this case two signatures 7*a*, 7*b*, which are transported in a transport direction T from a first folding station 3 to a second folding station 4. A distance b between the first signature 7*a* and the second signature 7*b* normally lies in a range from 5 to 8 cm. In the following, second folding station 4, the signatures 7*a* and 7*b* are folded three times, with sheet parts having the same dimensions being produced. The sheet parts are indicated in FIG. 1A. Through the use of the folds in the second folding station 4, a respective signature 7*a*, 7*b* is divided into four equal-sized parts.

Figure 1B:
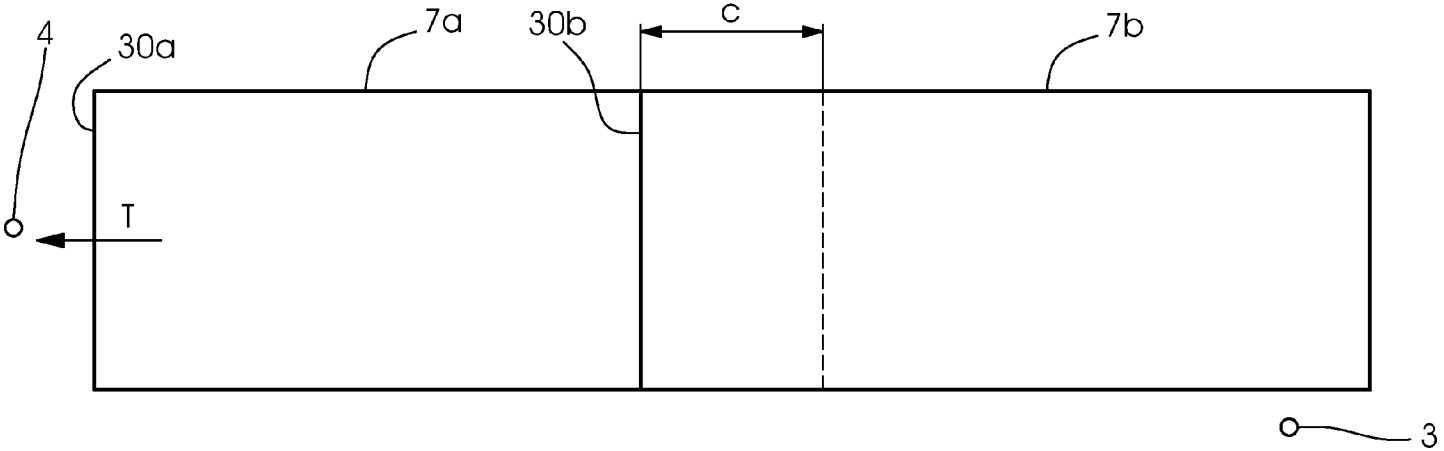
FIG. 1B is a top-plan view showing two overlapped signatures.

In FIG. 1B, two signatures 7*a*, 7*b* are shown, which come from a first folding station 3 and are transported to a second folding station 4 in the transport direction T. In this case, the signatures 7*a* and 7*b* are transported with an overlap c. The second signature 7*b* covers the upstream end of the signature 7*a*. In the example of FIG. 1B, three folds are produced, so that a respective signature 7*a*, 7*b* is divided into four equal sheet parts. The overlap c amounts to one quarter of the length of the signatures 7*a*, 7*b*. As opposed to the spaced transport of the two signatures 7*a* and 7*b*, illustrated in FIG. 1A, in the case of the overlapped transport according to FIG. 1B the second signature 7*b* is displaced in the transport direction T by the sum of the signature spacing b and the overlap c. In order to fold the signatures 7*a*, 7*b* in the second folding station 4, the signatures 7*a*, 7*b* have to cover a shorter distance. This means that, with the machine speed, i.e. the transport speed, remaining constant, more signatures can be processed to form finished folded products and the output of the folding machine 1 can be increased. Alternatively, the output of the folding machine 1 can be maintained and the transport speed of the signatures 7*a*, 7*b* can be reduced, in particular if material that is difficult to process is involved, which requires a lower transport speed in order to ensure a high quality of the products.

Figure 2A:
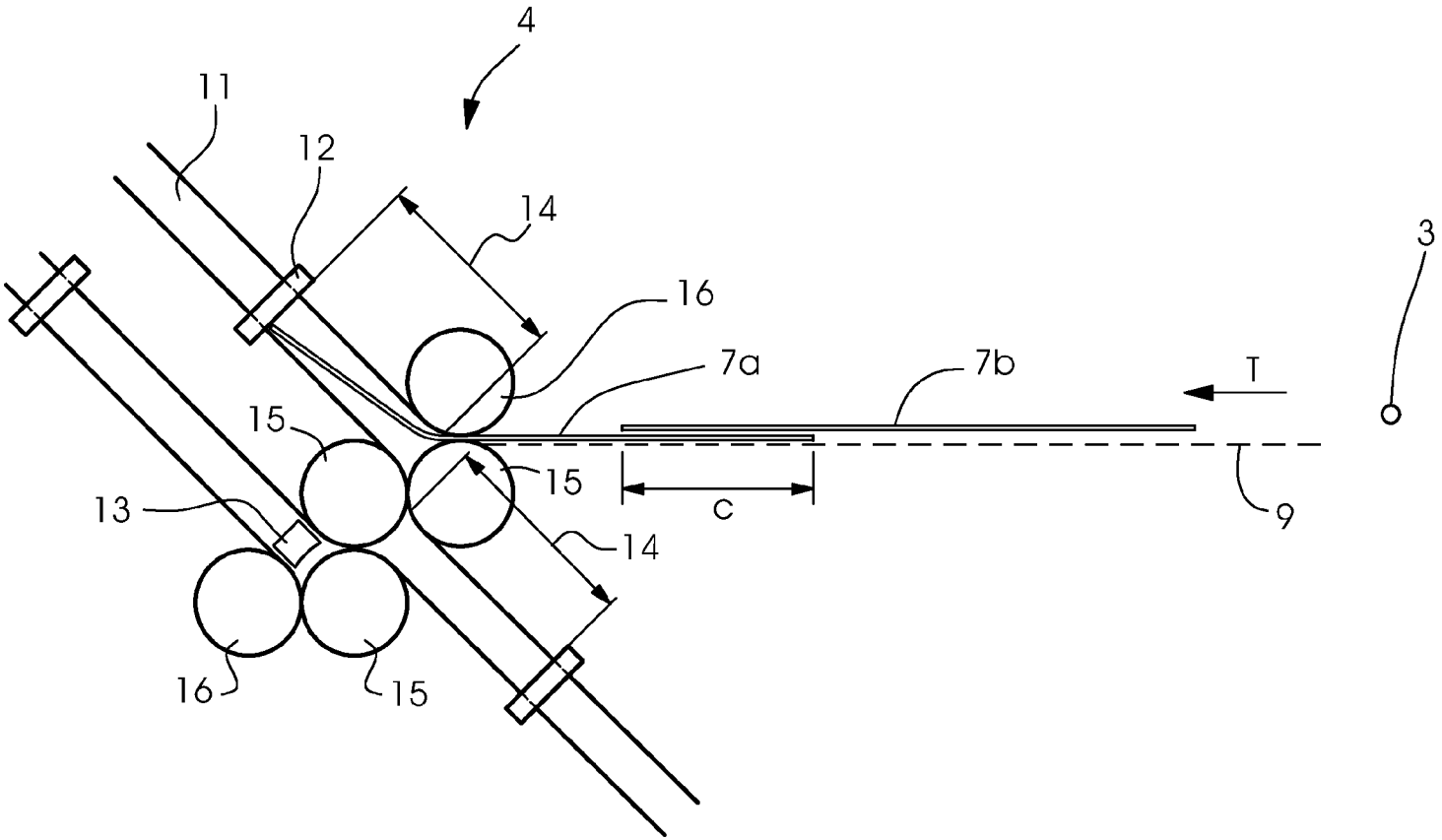
FIG. 2A is a longitudinal-sectional view showing a situation when a first signature runs into a folding station.
Figure 2B:
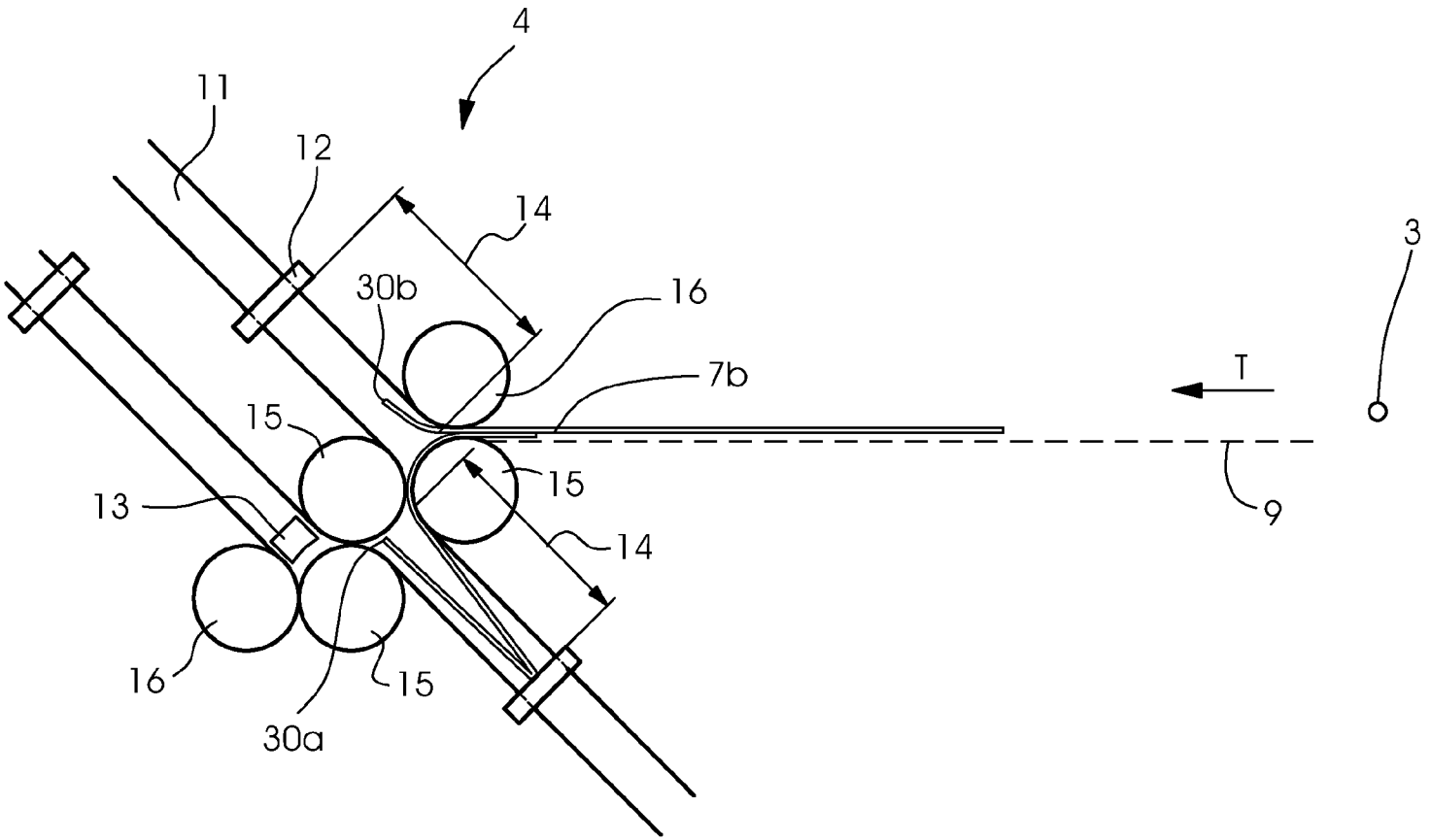
FIG. 2B is a view similar to FIG. 2A showing a situation when a second signature runs into the folding station.
Figure 2C:
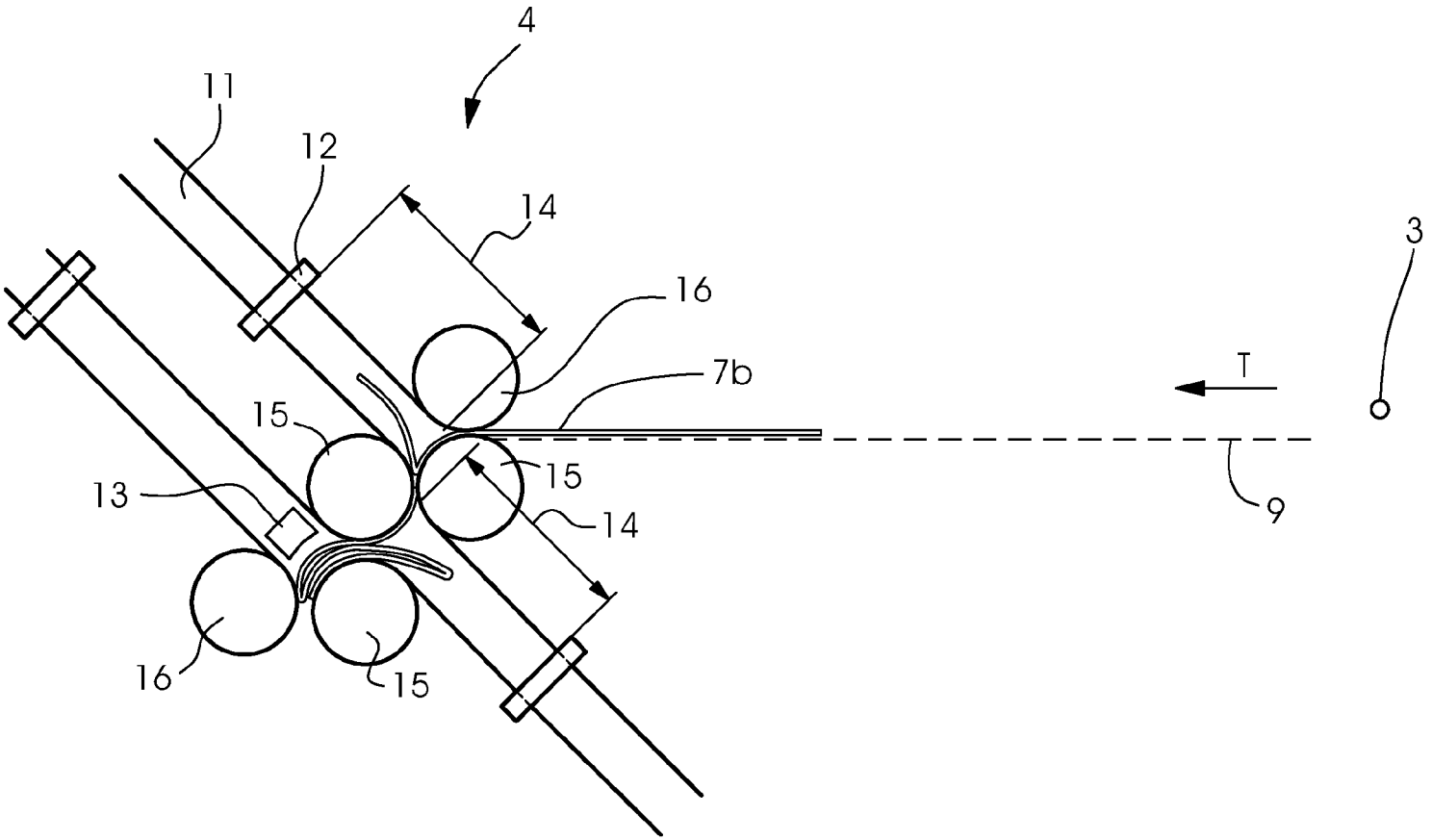
FIG. 2C is a view similar to FIGS. 2A and 2B showing a situation with both signatures in the folding station.

FIGS. 2A to 2C illustrate how the overlapped signatures 7*a*, 7*b* are folded in the pocket folding units of the second folding station 4. A first snapshot is illustrated in FIG. 2A. The signatures 7*a*, 7*b*, coming from a first folding station 3, are supplied to the second folding station 4 in the transport direction T over a feed table 9. In this case, the signatures 7*a*, 7*b* have an overlap c. The first signature 7*a* has already run into a first folding pocket 11, located at the top. A pocket stop 12 of the folding pocket 11 has been set to an infeed length (folding length) 14. The infeed length 14 in this case corresponds to one third of the length of the signatures 7*a*, 7*b*. A second snapshot is illustrated in FIG. 2B. The first signature 7*a* has already left the first folding pocket 11 located at the top. A first fold has been produced by folding rolls 15, and the first signature 7*a* is already in a second folding pocket 11, located at the bottom. The second signature 7*b* is just running into the first folding pocket 11, located at the top. The illustrated adjustment of the infeed lengths 14 of the folding pockets 11 ensures that the signatures 7*a* and 7*b* do not meet in the second folding station 4 in such a way that a relative speed arises between the first signature 7*a* and the second signature 7*b*. In the infeed region of the second folding station 4 underneath transport rolls 16, the first signature 7*a* and the second signature 7*b* touch but are moved at the same speed. Since no relative speeds occur between the first signature 7*a* and the second signature 7*b*, markings are prevented. Through the use of the first fold, a leading edge 30*a* of the first signature 7*a* is laid over in such a way that a distance to a leading edge 30*b* of the following signature 7*b* is greater than zero. FIG. 2C illustrates a third snapshot. The first signature 7*a* has already been finally folded and is being transported past a third folding pocket and removed from the second folding station 4. In this case, a sheet diverter 13 prevents the first signature 7*a* from running into the third folding pocket 11. A first fold is produced in the second signature 7*b* by the folding rolls 15. In this case, too, the first signature 7*a* and the second signature 7*b* do not meet and no relative movement between the two signatures 7*a*, 7*b* occurs.

The folding station 4, which is illustrated, has three folding pockets 11. According to the invention, however, the folding station 4 could have any desired number of folding pockets 11.

Figure 3A:
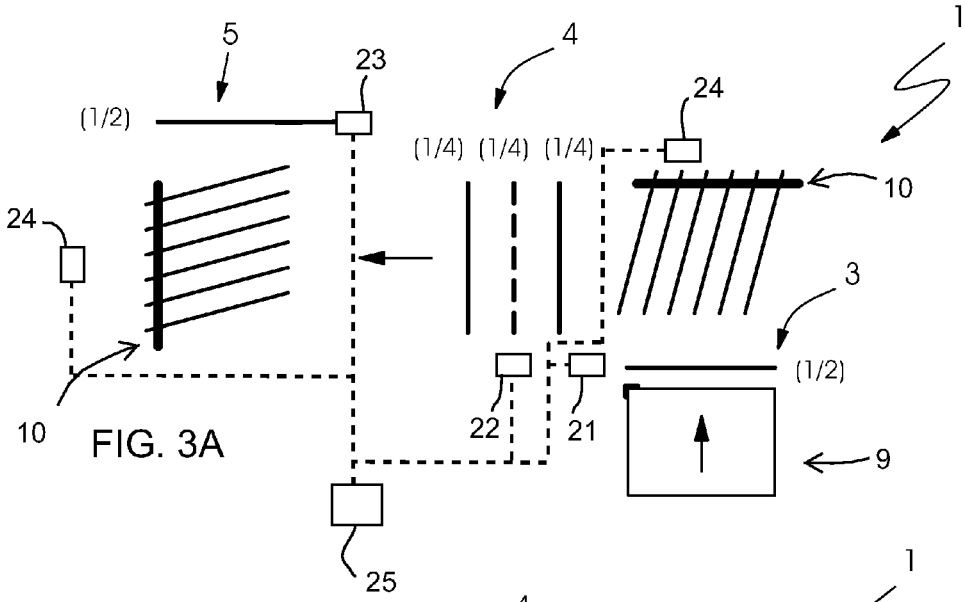
FIG. 3A is a top-plan view showing a first possible folding unit configuration.
Figure 3B:
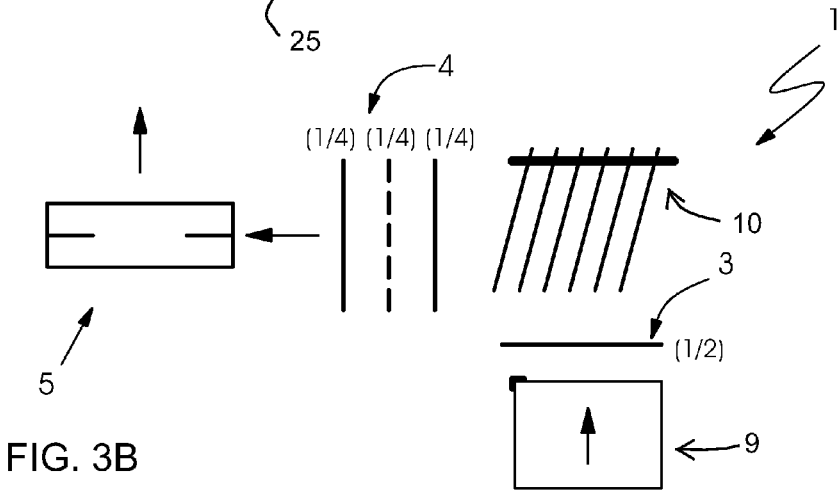
FIG. 3B is a top-plan view showing a second possible folding unit configuration.
Figure 3C:
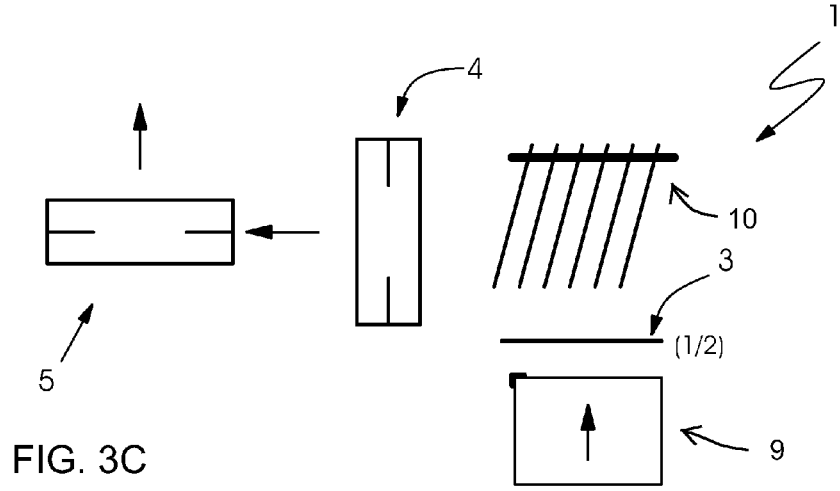
FIG. 3C is a top-plan view showing a third possible folding unit configuration.

In FIGS. 3A, 3B and 3C, two possible variants for the structure of a folding machine 1 are illustrated by way of example. The folding machine according to FIG. 3A has a first folding station 3, which is implemented as a pocket folding unit having one pocket, a second folding station 4, which is implemented as a pocket folding station having at least three folding pockets, and a third folding station 5, which is implemented as a pocket folding unit having at least one folding pocket. The infeed lengths of the respective folding pockets are indicated in brackets and relate to the length of a respective incoming sheet. A central cross-fold is produced in the first folding station 3, which is downstream of the feed table 9. The signature produced is supplied to the second folding station 4 over a skew roller table or transport device 10 having a drive 24. As a result of the coordination of the transport speed in the first folding station 3 and the skew roller table, the signatures are supplied to the second folding station 4 by the skew roller table in an overlapped manner—as illustrated in FIG. 1B. There, three zigzag folds are produced, the first zigzag fold being produced in the first, upper folding pocket. The signatures can be transported onward from the second folding station over a further skew roller table or transport device 10 having a drive 24 to a third folding station 5, where a central cross-fold is produced as the final fold. The folding stations 3, 4, 5 each have at least one drive 21, 22, 23. All of the drives 21, 22, 23, 24 are connected to a common control unit 25. An alternative structure of the folding machine 1 for the production of the same product is illustrated in FIG. 3B. Instead of the second skew roller table and the following pocket folding unit, in this case a blade folding unit 5 is employed. A further alternative structure of the folding machine 1 is illustrated in FIG. 3C. In this case, the second folding station 4 is implemented as a parallel blade folding unit. The signatures are supplied to the parallel blade folding unit from the skew roller table in an overlapped manner. Still further parallel blade folding units or pocket folding units can follow the illustrated parallel blade folding unit in order to be able to execute a number of parallel folds in this station.

Depending on the paper format and the machine configuration, and also as a result of different overlaps, an extremely wide range of signatures can be produced through the application of the invention:

For example, a 32-page booklet can be produced through the use of a center fold, followed by three zigzag folds, followed by a center fold with an overlap of at most ¼; or a 16-page booklet can be produced through the use of a center fold, two following zigzag folds and a wound fold with an overlap of at most ¼; a 12-page booklet can be produced through the use of a first center fold, followed by two wound folds with an overlap of at most ⅓; or a 24-page booklet can be produced through the use of a first center fold, followed by two zigzag folds, followed by a center fold with an overlap of at most ⅓. In this case, the statements relating to the overlap in each case relate to the second folding station.

This enumeration is not to be understood as final, but is instead intended to illustrate the diverse possibilities when the invention is applied. An overlap of ¼ is illustrated in FIG. 1B. FIG. 2A illustrates an overlap of ⅓.

The invention claimed is:

1. A method for folding sheet elements in a folding machine having a folding station with at least one folding unit, the method comprising the following steps:

supplying the sheet elements to the folding station in a transport direction with leading edges of the sheet elements in front and with an overlap;

folding the sheet elements upward with a first folding length in the at least one folding unit;

producing a fold transversely with respect to the transport direction to create a first folded product;

setting a spacing in the folding station between the leading edge of a first folded sheet element and the leading edge of a following sheet element in each case to be greater than or equal to zero; and dimensioning the overlap to correspond at most to the first folding length.

2. The folding method according to claim 1, wherein the at least one folding unit is a pocket folding unit.

3. The folding method according to claim 1, wherein the at least one folding unit is a parallel blade folding unit.

4. The folding method according to claim 1, which further comprises processing the first folded product further by subsequent further folding.

* * * * *